US007097513B2

(12) United States Patent
Bryan

(10) Patent No.: US 7,097,513 B2
(45) Date of Patent: Aug. 29, 2006

(54) TELECOMMUNICATION CONNECTOR

(75) Inventor: Daniel Bryan, Baltimore, MD (US)

(73) Assignee: American Power Conversion Corporation, West Kingston, RI (US)

( * ) Notice: Subject to any disclaimer, the term of this patent is extended or adjusted under 35 U.S.C. 154(b) by 0 days.

(21) Appl. No.: 10/915,212

(22) Filed: Aug. 10, 2004

(65) Prior Publication Data

US 2006/0035528 A1 Feb. 16, 2006

(51) Int. Cl.
*H01R 24/00* (2006.01)

(52) U.S. Cl. ..... 439/676; 439/410

(58) Field of Classification Search ..... 439/409, 439/410, 418, 676, 701
See application file for complete search history.

(56) References Cited

U.S. PATENT DOCUMENTS 4,758,536 A * 7/1988 Miller et al. ..... 439/138
6,302,723 B1 * 10/2001 Baum et al. ..... 439/412
6,394,835 B1 * 5/2002 Milner et al. ..... 439/404
6,547,604 B1 * 4/2003 Arnett et al. ..... 439/676

* cited by examiner

*Primary Examiner*—Khiem Nguyen
(74) *Attorney, Agent, or Firm*—Mintz, Levin, Cohn, Ferris, Glovsky and Popeo, P.C.; Shane H. Hunter

(57) ABSTRACT

A telecommunications connector system for connecting to a mating telecommunications jack includes a housing that is configured to provide a contact chamber, a carrier configured to receive a plurality of insulated conductive lines, and electrically-conductive contacts at least partially disposed in the carrier, each contact including first, second, and third portions, each of the first portions being movably connected to the second portion and configured to move relative to the second portions in response to applied forces and to return to resting positions in response to removal of the applied forces, each of the third portions being movably connected to a corresponding second portion and including a blade configured to pierce an insulator coating of a corresponding insulated conductive line received by the carrier, where the carrier is at least partially disposed inside the housing such that the contacts are at least partially disposed in the contact chamber.

17 Claims, 11 Drawing Sheets

TELECOMMUNICATION CONNECTOR

FIELD OF THE INVENTION

The invention relates to telecommunications cable terminations.

BACKGROUND OF THE INVENTION

The use of telecommunications in today's society increases at an incredibly rapid pace. As the use of telecommunications increases, so to does the corresponding need for telecommunications infrastructure. Such infrastructure includes cabling, switching systems and connectors for cabling to connect to the switching systems and for connection to telecommunications' devices such as telephones, fax machines, etc. As more telecommunication infrastructure is used in single locations (e.g., to accommodate more and more telecommunications devices at single locations) telecommunications infrastructure becomes more and more complex and crowded. Thus, as with many things in today's society there is a drive for smaller and more economical devices in telecommunications infrastructure.

There are several existing styles of telecommunications cable connectors that exist today. For example, insulation displacement connectors (IDC) exist currently. These connectors are assembled by inserting individual wires into slots in a wire termination area of the connector, and then moving the movable portion of that connector toward another portion of the connector to close the connector and simultaneously force metal contacts through the insulation of the wire and into contact with the conductors of the wires. Other connectors include receptacles where individual wires are assembled by inserting the wires into the receptacles. A pair of blades exposed within the receptacles split the insulation around the wire and make contact with the conductor inside the insulation.

SUMMARY OF THE INVENTION

In general, in an aspect, the invention provides a telecommunications connector system for connecting to a mating telecommunications jack, the connector system including a housing that is configured to provide a contact chamber, a carrier configured to receive a plurality of insulated conductive lines, and electrically-conductive contacts at least partially disposed in the carrier, each contact including first, second, and third portions, each of the first portions being movably connected to the second portion and configured to move relative to the second portions in response to applied forces and to return to resting positions in response to removal of the applied forces, each of the third portions being movably connected to a corresponding second portion and including a blade configured to pierce an insulator coating of a corresponding insulated conductive line received by the carrier, where the carrier is at least partially disposed inside the housing such that the contacts are at least partially disposed in the contact chamber.

Implementations of the invention may include one or more of the following features. The carrier provides grooves corresponding to the contacts such that portions of the contacts can be inserted into the grooves, and walls providing the grooves help to retain the contacts within the carrier and help to electrically isolate the contacts from each other. At least the third portions of the contacts are disposed in the grooves and heights of the walls of the carrier providing the grooves have at least two different heights, the walls being relatively smaller under the first portions of the contacts and being relatively larger where the third portions of the contacts are disposed in the grooves. The grooves under the first portions of the contacts are configured to allow the first portions of the contacts to move in the grooves. The carrier provides holes for receiving the insulated conductive lines, the holes being aligned with a respective one of the grooves. The carrier includes barriers each disposed between a respective one of the grooves and a respective one of the holes. The third portions of the contacts are configured to be disposed around the barriers and to move relative to the second portions such that the blades will pierce the insulated conductive lines if the lines are disposed in the holes adjacent to the barriers. The system further includes the insulated conductive lines, and the blades are wedged into the conductive lines through insulator casings of the insulated conductive lines and held in place by friction.

In general, in another aspect, the invention provides a multi-user telecommunications outlet assembly system including a first subsystem cable including a first set of connector cables each including a plurality of insulated conductive lines, and a first set of telecommunications connectors for connecting to mating telecommunications jacks, each connector of the first set of connectors coupled to a corresponding connector cable of the first set and including: a housing that is configured to provide a contact chamber; a carrier configured to receive a corresponding set of the insulated conductive lines, the corresponding set of the insulated conductive lines being partially disposed in the carrier; and electrically-conductive contacts at least partially disposed in the carrier, each contact including first, second, and third portions, each of the first portions being movably connected to the second portion and configured to move relative to the second portions in response to applied forces and to return to resting positions in response to removal of the applied forces, each of the third portions being movably connected to a corresponding second portion and including a blade configured to pierce an insulator coating of a corresponding insulated conductive line received by the carrier, where the carrier is at least partially disposed inside the housing such that the contacts are at least partially disposed in the contact chamber.

Implementations of the invention may include one or more of the following features. The system further includes a second subsystem cable similar to the first subsystem cable, a second set of telecommunications connectors similar configured and coupled similarly to the first set of telecommunications connectors, and a rack-mountable faceplate providing openings through which the first and second sets of telecommunications connectors are respectively disposed.

In general, in another aspect, the invention provides a telecommunications cable including a housing providing a contact chamber and a connector receptacle, insulated wires, an electrically-insulating contact carrier coupled to the housing and disposed at least partially in the housing and including a set of walls that provide grooves, the grooves having first regions of a first depth and a second region of a second, deeper, depth, the contact carrier providing a plurality of wire holes, each wire hole aligned with a corresponding one of the grooves, each of the wire holes including a trough portion in which the carrier provides less than a full circumference wall, electrically-conductive contacts, each contact being a monolithic conductor, each contact including a base portion, an upper portion, and a blade portion, the base portion being disposed in a corresponding one of the grooves, the upper portion being disposed at least partially in the contact chamber and being configured and arranged to bend relative to the base portion to bias against and make electrical contact with a mating contact of a mating connector inserted into the connector receptacle, at least a portion of the blade portion being disposed in the second region of the corresponding groove, the blade portion including a blade disposed through a portion of an insulating shell of a corresponding one of the insulated wires and making electrical contact with the wire.

Implementations of the invention may include one or more of the following features. Each blade of the contacts biases the corresponding one of the insulated wires against a wall of the carrier providing the trough portion of the corresponding wire hole such that the blade is inhibited, by friction between the blade and the insulated wire, from being removed from insulated wire. The system consists essentially of the housing, the wires, the carrier, and the contacts. Each of the blades includes cutting points disposed along a length of the corresponding contact. The carrier includes barriers separating the first portions of the grooves from the trough portions of the wire holes. The contacts are disposed about the barriers, with the blades on first sides of the barriers and the base portions on second, opposite sides of the barriers.

In general, in another aspect, the invention provides a telecommunications connector system for connecting to a mating telecommunications jack, the connector system including a housing that is configured to provide a contact chamber, a carrier configured to receive a plurality of insulated conductive lines, and electrically-conductive contacts at least partially disposed in the carrier, each contact including a first portion configured to make electrical contact with a corresponding one of the conductive lines, a second portion connected to the first portion by a first bend in the contact, and a third portion connected to the second portion by a second bend in the contact, the third portion being configured and arranged to make electrical contact with mating contacts of a mating connector received by the telecommunications connector system, where the contacts are each configured to flex at the first bend, such that forces are developed in the first bend, in response to the third portion being pressed upon by one of the mating contacts.

Implementations of the invention may include one or more of the following features. The carrier is configured to provide room below each of the second portions of the contacts with the first bends in unflexed states such that the second portions of the contacts can move into the room as the contacts flex at the first bends. The first bend is configured such that the forces developed in the first bend cause reduced amounts of force to be developed in the first portion and the second bend than if the first portion was connected to the second portion without the first bend.

Various aspects of the invention may provide one or more of the following capabilities. A telecommunications connector can be provided without using additional intermediate interface connector components to terminate wires. Telecommunications connectors can be provided with electrical contacts that are not soldered to corresponding wires. Termination contacts can be provided in a telecommunication connector that are part of the same component as the jack contacts. Connector contacts can be mass terminated to wires in a single operation to assemble a telecommunications connector. A connector can be provided with or without cable strain relief. A telecommunications connector can be provided with a short body construction of approximately 22 mm in length or less. A telecommunications connector can be provided with positive, dynamic contact position retention during and after termination. A telecommunication connector can occupy less space than previous connectors and/or use fewer components and/or less costly components than previous connectors. A telecommunications connector can be terminated faster and/or with less labor than with previous connectors. Outlet box space can be better utilized. Reduced size MUTOA (multi-user telecommunications outlet assembly) devices can be created using the connector. A telecommunications connector can be provided that is applicable to the 2, 4, 6, 8, 10, or more pin circuits for low and/or high bandwidth applications. Terminated connector can also be introduced into a patch cable type housing and used as a network extension cable, not being incorporated with additional panels, wall plates or housings.

These and other capabilities of the invention, along with the invention itself, will be more fully understood after a review of the following figures, detailed description, and claims.

DETAILED DESCRIPTION OF PREFERRED EMBODIMENTS

Embodiments of the invention provide techniques for manufacturing and providing connectors, in particular for telecommunications. The connectors in accordance with embodiments of the invention can have relatively few parts and a relatively compact size with a small foot print. An exemplary embodiment includes a housing that contains a contact carrier, and the contract carrier contains and holds a set of electrical contacts. The contacts are configured to be pre-inserted into the contact carrier, and with wires inserted into the contract carrier, blade portions of the contacts can be moved down into the wires. Contact grooves provide sufficient friction force to maintain contact placement prior to and after termination. This friction fit helps to retain the contacts within the contact carrier when assembled preferably without additional parts or adhesives used to hold the contacts in the contact carrier. The blades are configured to pierce insulation of the wire and to be moved into contact with conductors inside the insulation, making electrical connections with the conductors of the wires. The assembled contact carrier and contact combination, with the contacts connected to the wire conductors, is inserted into the housing for completion of the telecommunications connector. Other embodiments are within the scope and spirit of the invention.

Figure 1:
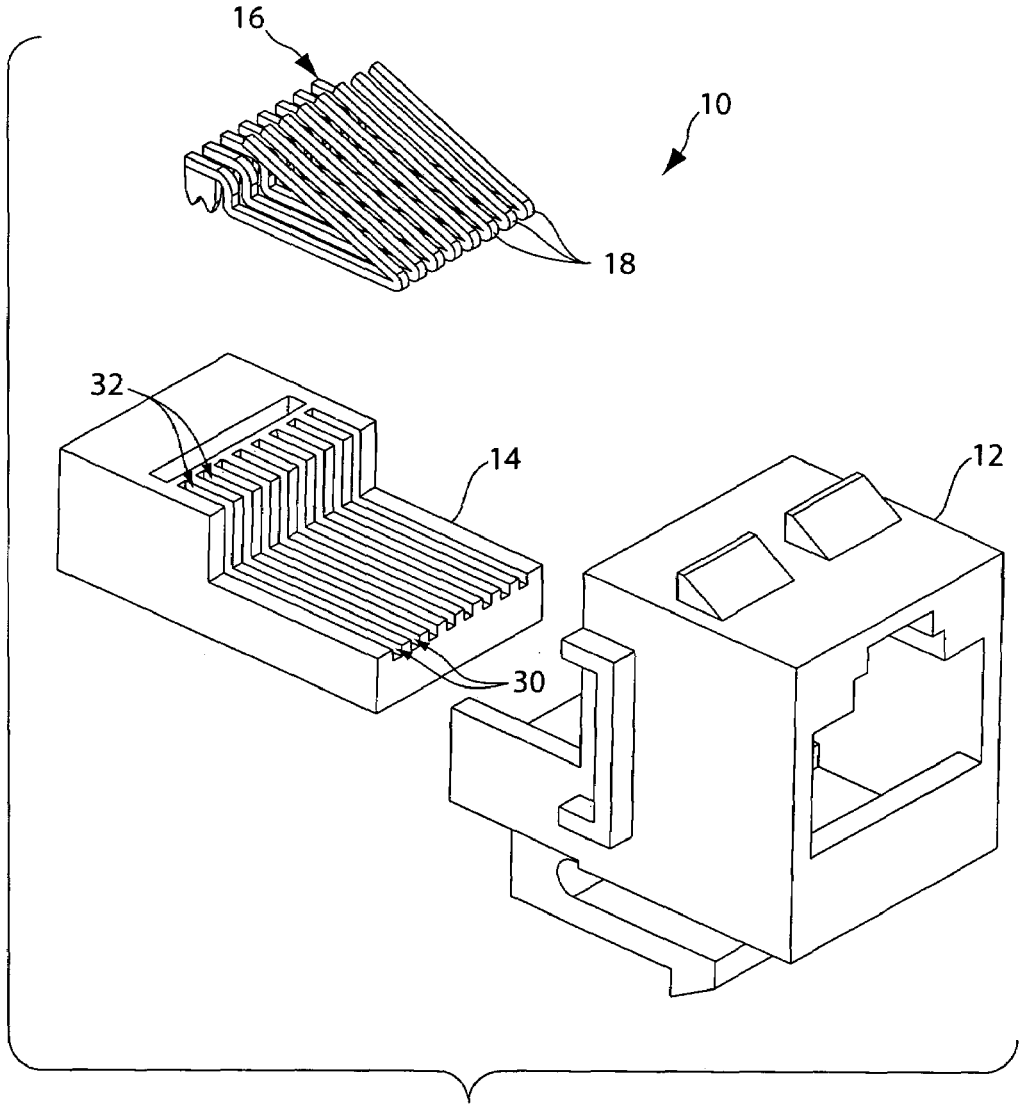
FIG. 1 is an exploded perspective view of a telecommunications connector according to the invention.
Figure 2:
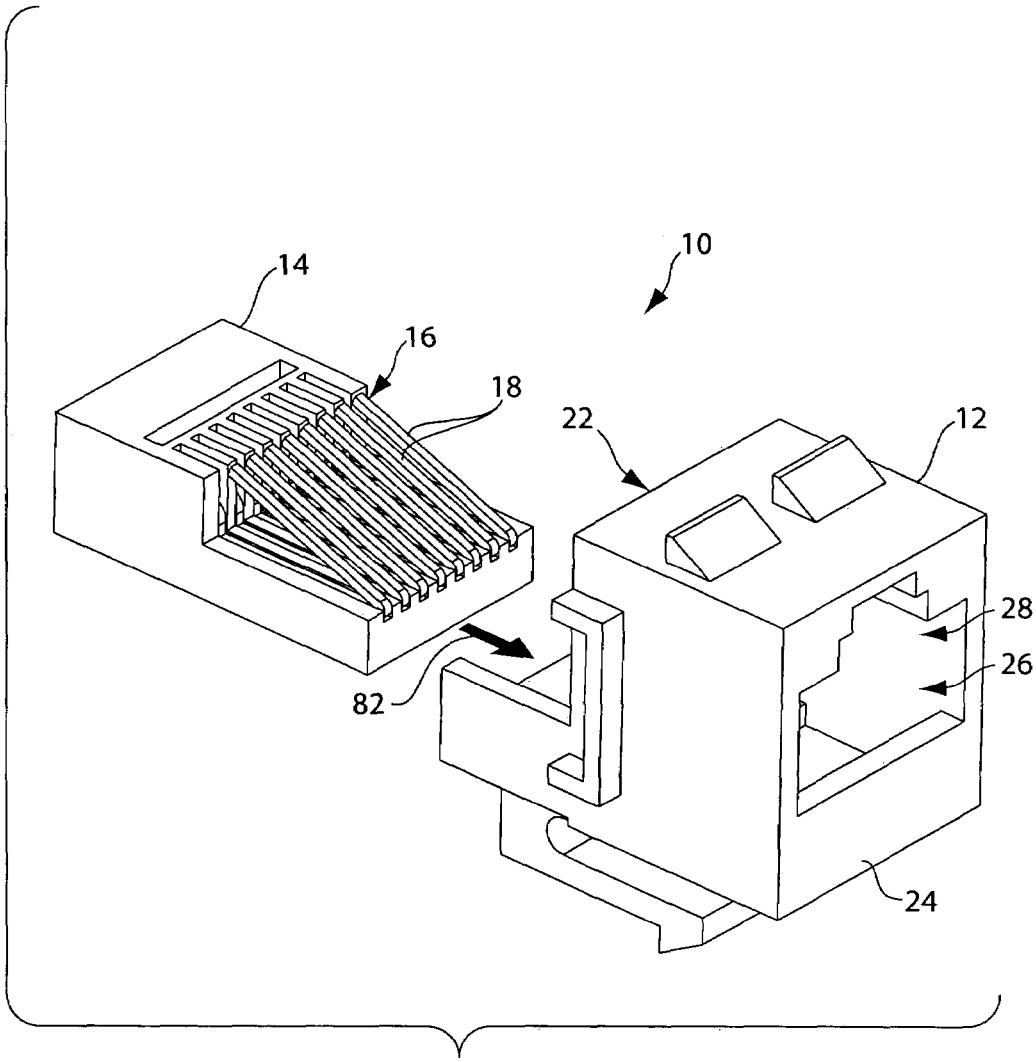
FIG. 2 is a partially exploded perspective view of the connector shown in FIG. 1.
Figure 3:
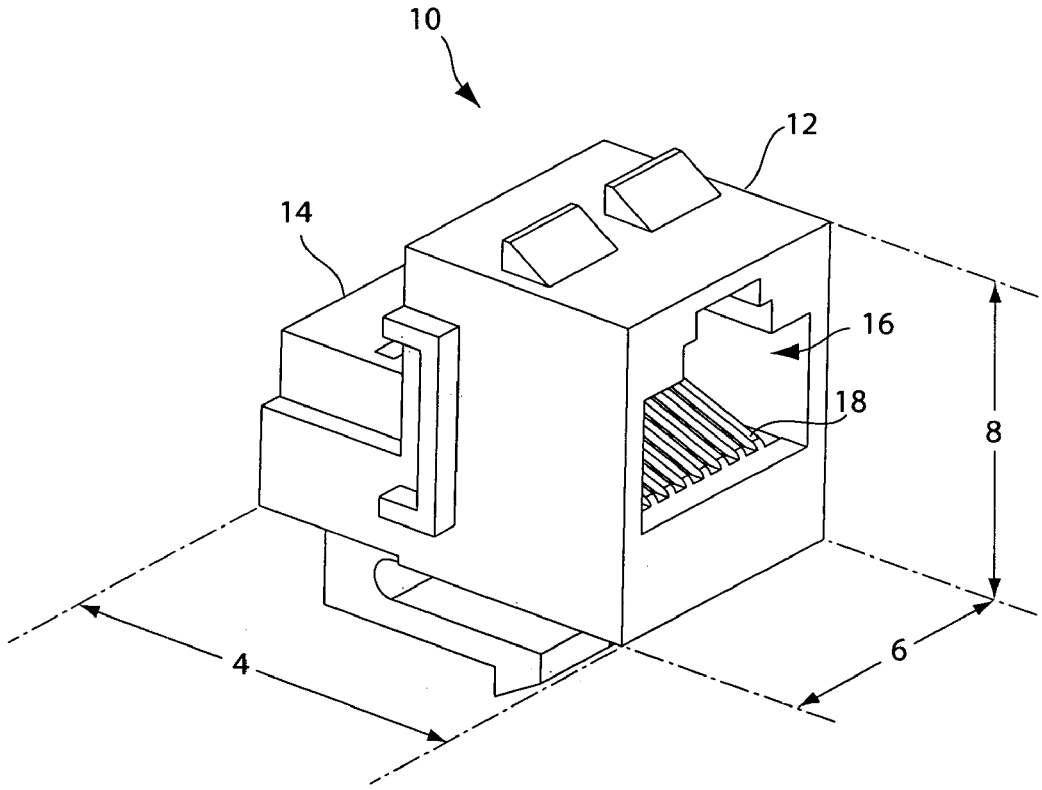
FIG. 3 is a perspective assembled view of the connector shown in FIGS. 1 and 2.

Referring to FIGS. 1–3, a telecommunications connector 10 includes a housing 12, a contact carrier 14, and a set 16 of contacts 18. The housing 12, and the contact carrier 14 are preferably made out of an electrically insulating material such as a plastic. When assembled, the connector 10 is preferably configured to provide a standard category 5e, 6 (CAT 5e, Cat6) connection for telecommunications, although other forms of connectors are possible. The contacts 18 are made of an appropriately electrically conductive material such as gold-plated phosphor, bronze, or an appropriate alloy. Preferably, the assembled connector shown in FIG. 3 has dimensions of about 22 mm or less in length 4, about 18 mm or less in width 6, and about 24 mm or less in height 8.

The housing 12 is configured to receive the carrier 14 and the contact set 16, as assembled, into a mating receptacle 22 that is configured to receive the combination of the contact carrier 14 and the contact set 16. A front wall 24 of the housing 12 provides an end for the receptacle 22. The front wall includes an opening 26 configured to receive an appropriate telecommunications mating connector plug for insertion into the housing 12 for connection with the contacts 18. The opening 26 includes a cut-out 28 sized for receiving a tab on a mating connector inserted into the opening 26. The mating connector can be inserted through the opening 26 and the tab, that is spring biased, can move upwardly once inserted to help retain the mating connector within the housing 12. The opening 26, as shown, has a height of approximately 6.8 mm, a width of approximately 11.9 mm, and a depth of approximately 10.8 mm.

The contact casing 14 is configured to receive and hold or retain the set 16 of contacts 18, and a set of wires. As shown, the casing 14 is preferably substantially L-shaped.

Figure 4:
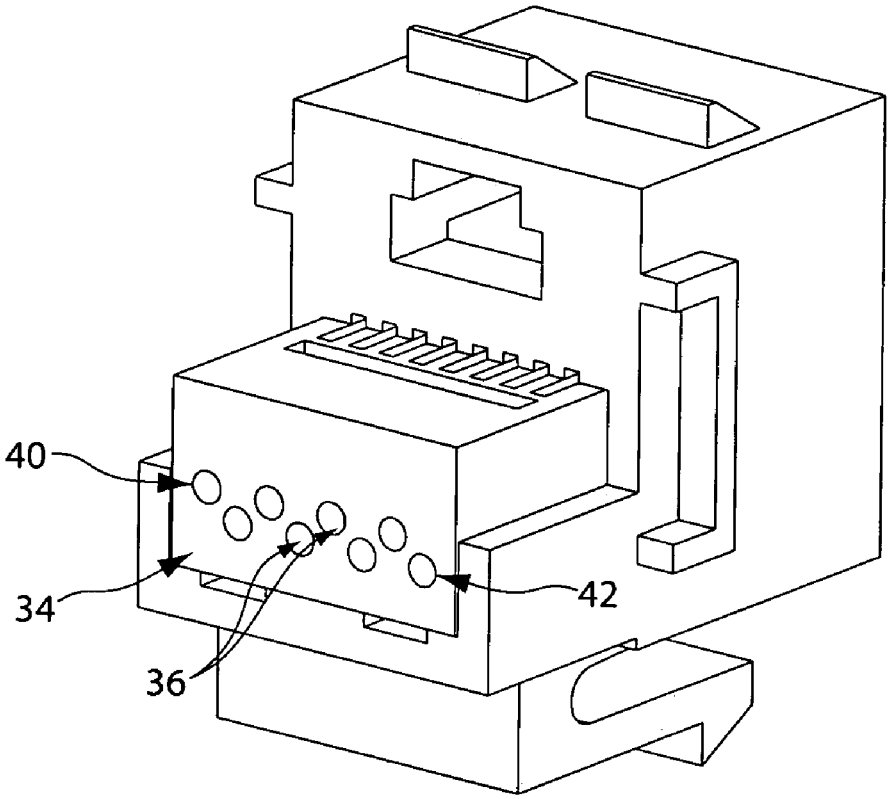
FIG. 4 is a perspective view of the connector shown in FIGS. 1–3 with wire insertion channels at a rear of the connector.

As shown in FIG. 1, the casing 14 provides a set of lower grooves or slots 30 and a corresponding set of upper grooves or slots 32 that are in alignment with the lower slots 30. Referring also to FIG. 4, the casing 14 provides an equal-in-amount corresponding set 34 of wire holes 36 that are sized for receiving standard 24 or 26 AWG wires with insulation.

Figure 5:
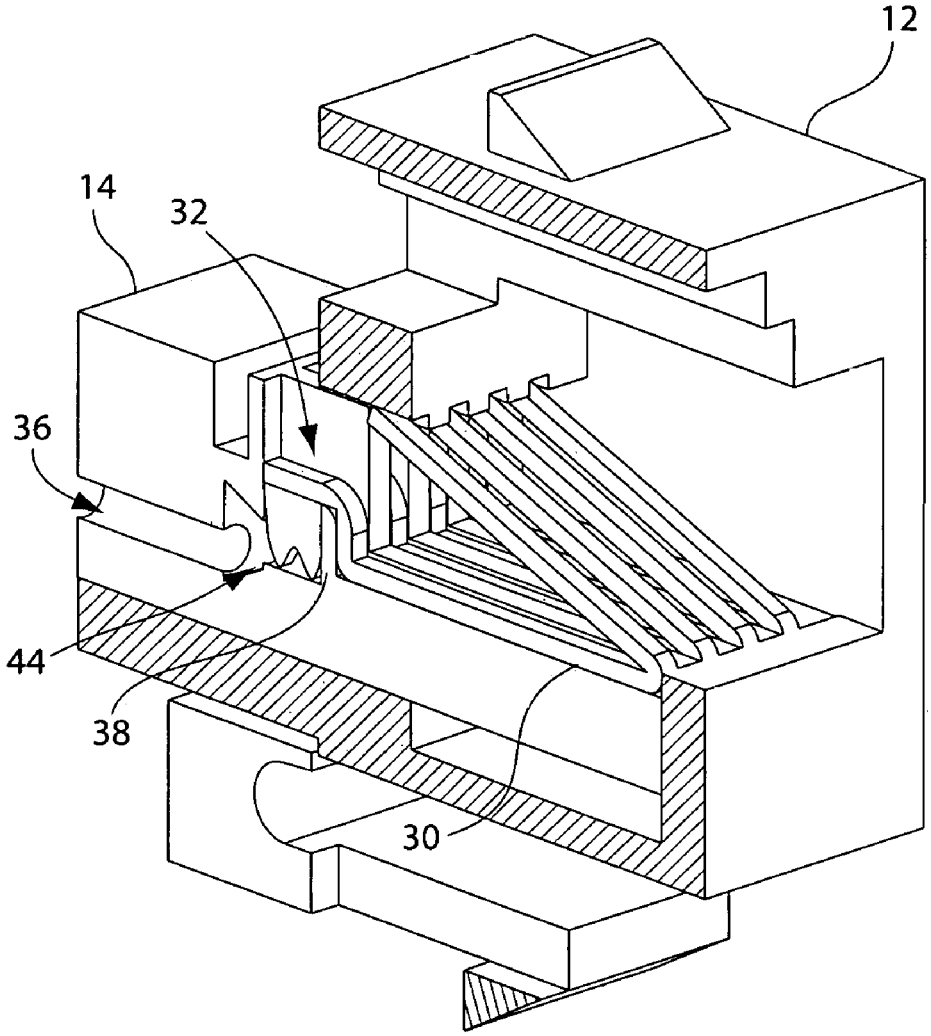
FIG. 5 is a partially cut-away view of the connector shown in FIG. 4.

The quantity of the wire holes 36 is the same as the quantity of the upper slots 32 and the lower slots 30. As shown in FIG. 4, the wire holes 36 provided by the contact casing 14 and are arranged in two off-set rows 40, 42 such that the holes 36 in the upper row 40 are horizontally displaced from the holes 36 in the lower row 42 such that holes in the two rows 40, 42 are not vertically over-lapping. Thus, the wire holes 36 in the upper row 40 correspond to alternating ones of the upper grooves 32, and the wire holes 36 in the lower row 42 correspond to other alternating ones of the upper grooves 32, interlaced with the upper grooves 32 corresponding to the wire holes 36 of the upper row 40. The wire holes 36 are sized to receive a desired size of wires, but provide little room beyond the diameter of the corresponding desired-size wire. Referring also to FIG. 5, barrier tabs 38 are provided by the contact casing 14 to separate the wire holes 36 from the lower grooves or slots 30. Portions of the wire holes 36 beneath the upper grooves 32 do not have upper containment and thus are wire trough portions 44 of the holes 36. The holes 36 become the troughs 44 because the upper grooves 32 extend down to the holes 36, so that a portion of the wall surrounding the hole 36 does not exist in the region beneath the upper grooves 32.

Figure 6:
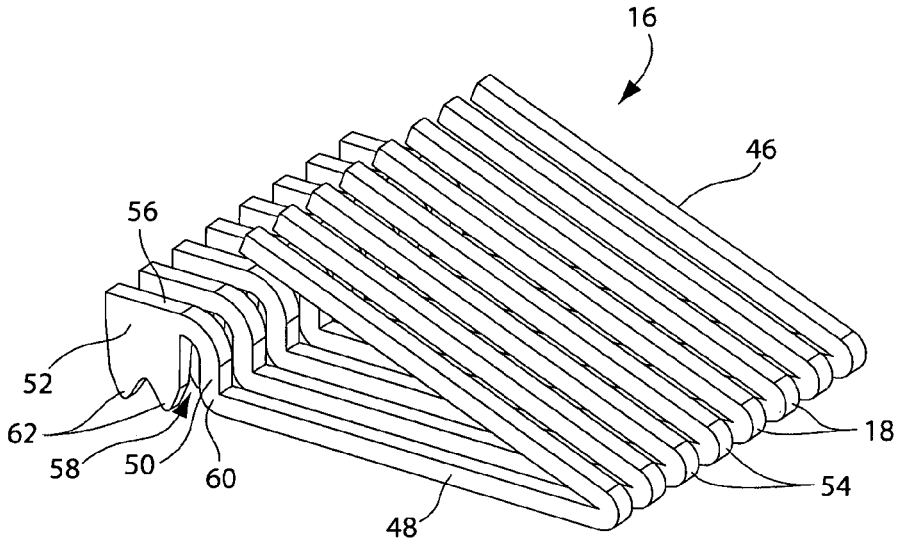
FIG. 6 is a perspective view of a set of electrical contacts that are part of the connector shown in FIGS. 1–3.

Referring to FIG. 6, each of the contacts 18 in the contact set 16 includes an upper portion 46, a lower portion 48, an arm 50, and a blade 52. The contacts 18 are shown in their resting positions. The contacts 18 are configured to flex about bends 54 such that the upper portions 46 can pivot toward the lower portions 48 about the bends 54. The contacts 18 are made of a resilient metal such that the contacts maybe repeatedly bent and will return to their resting position as shown in FIG. 6. The contact channels 30 provide additional space below the contacts 18 for flexing of the lower portions 48 to help prevent permanent contact distortion at the contact bends 54 that would leave the upper portions 46 in depressed positions. The arms 50 extend upwardly away from the lower portions 48 and then parallel to the lower portions 48 extending away from the upward portion in a direction away from the bends 54. The blade 52 extends downwardly from upper portions 56 of the arms 50. The arm 50 and the blade 52 provide a receptacle 58 that is configured to receive the vertical barrier 38 of the contact carrier 14 (FIGS. 4–5). The lower portions 48 of the contacts 18 are configured to fit within the lower grooves 30 of the contact carrier 14, preferably with a separating but floating fit.

The arms 50 are configured as resilient, bendable members that can pivot relative to the lower portions 48 about bends 60 where the arms 50 extend away from the lower portions 48 of the contacts 18. The arms 50 absorb contact movement to help prevent movement of the upper portions 46 from causing movement of the blades 52. The blades 52 are shown having two cutting points 62 although other numbers of cutting points 62, e.g., one, three, etc., are acceptable. The points 62 are displaced from each other along a length of the upper arm portion 56 (i.e., along a length of the contact 18). The cutting points 62 are configured to pierce insulation of the wires inserted into the wire holes 36 up to the vertical barrier 38 (FIG. 4). The blades 52, in particular the cutting points 62, are configured to make electrical contact with conductors of the wires in the wire holes 36. The blades 52 are preferably integrally formed as monolithic pieces with the arms 56. Indeed, preferably, the entire contact 18 is an integrally-formed monolithic piece. The blades 52 are configured as tapered members with narrow points at the cutting tips 62 with larger widths where the blades 52 meet the upper portions 56 of the arms 50. The blades 52 are configured to be inserted into the wires and to force the wires outwardly to contact walls of the wire troughs 44. This provides friction between the blades 52 and the wires in excess of the spring bias force of the arm 50 to help retain the blades 52 in electrical contact with the conductors of the wires.

Figure 7:
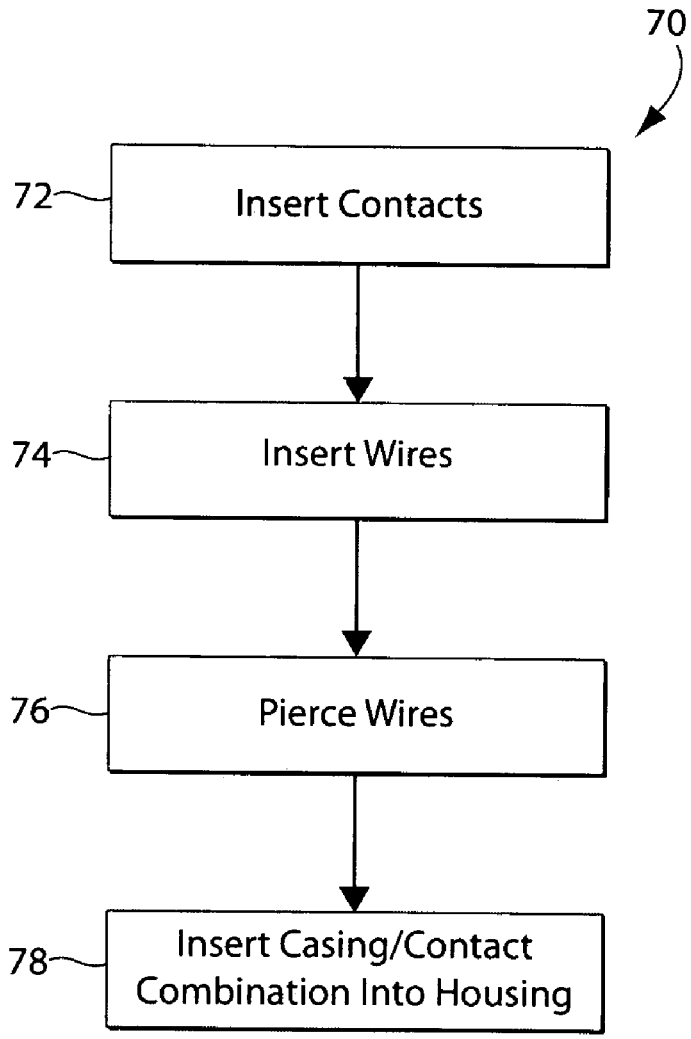
FIG. 7 is a block flow diagram of a process of assembling the connector shown FIGS. 1–3.

Referring again to FIG. 7, with further reference to FIGS. 1–3, a process 70 for assembling the connector 10 includes the stages shown. The process 70 is exemplary only, and not limiting. The process 70 can be modified, e.g., by adding, removing, and/or rearranging stages.

At stage 72, the connectors 18 are inserted into the grooves 30–32 of the contact casing 14. The lower portions 48 of the contacts 18 are inserted into the lower grooves 30 of the casing 14 while the arm portions, including the arms 50 and the blades 52 of the contacts 18 are inserted into the upper grooves 32.

At stage 74, the wires are inserted into the wire holes 36 until they butt up against the vertical barriers 38 of the contact carrier 14. Preferably, the wires are not stripped, thus leaving them with their insulation intact.

Figure 8:
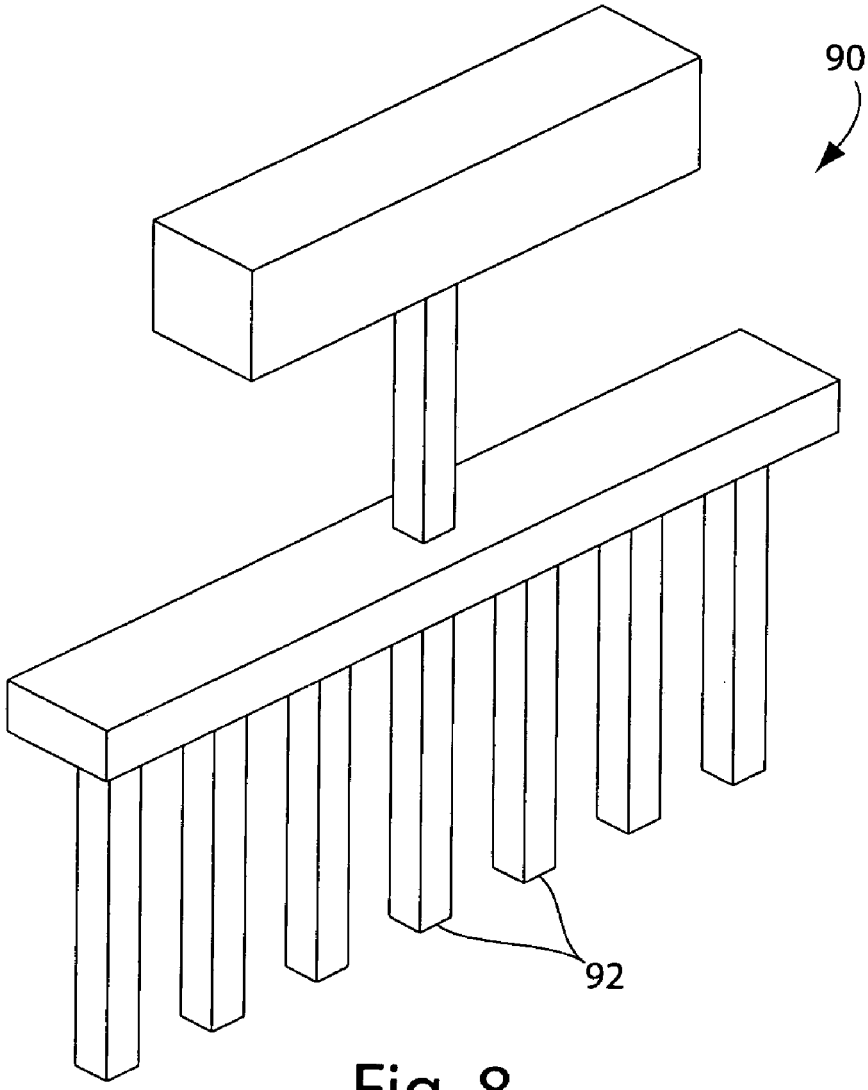
FIG. 8 is a perspective view of a tool for use in assembling the connector shown in FIGS. 1–3.
Figure 9:
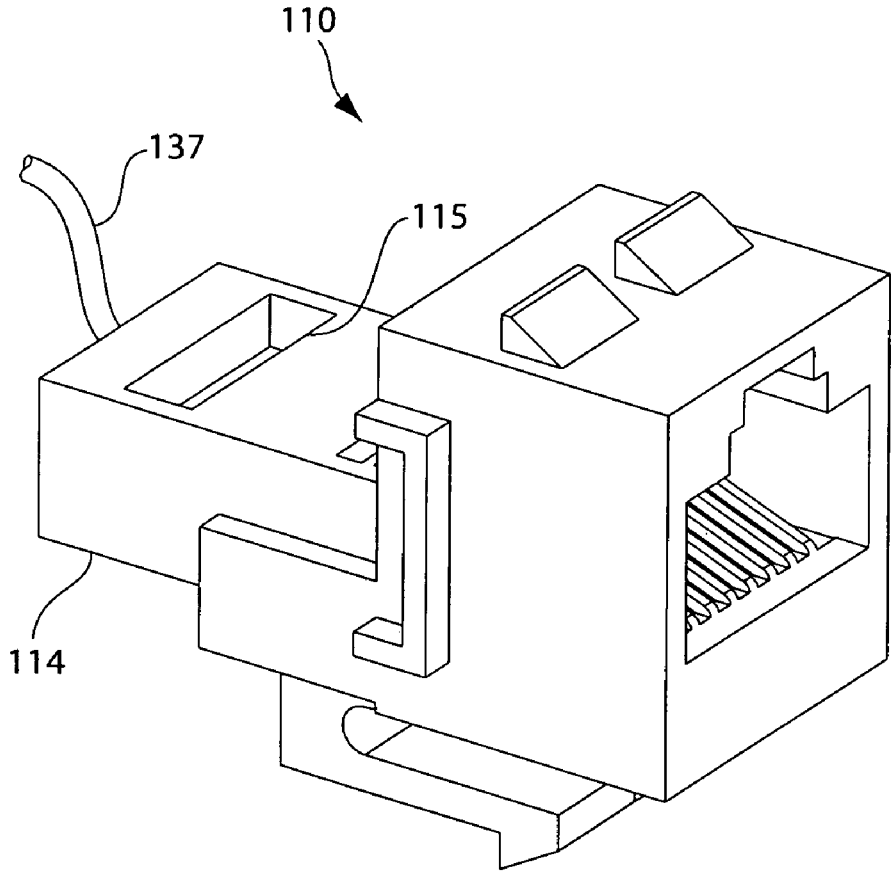
FIG. 9 is a perspective assembled view of an alternative telecommunications connector according to the invention.

At stage 76, the upper portions 56 of the arms 50 are pushed downwardly to cause the blades 52 and in particular the cutting points 62, to pierce the wires. The points 62 pierce through the insulation of the wires and into the conductors of the wires. The blades 52 push the conductors and the insulation outwardly to contact the walls of the wire troughs 44. The pressure exerted by the walls on the insulation is transferred through to the conductors and to the blades 52. Sufficient pressure is exerted on the blades 52 to provide a friction fit for the blades 52 in the wires, thus inhibiting upward movement of the blades 52 and helping to insure continued electrical contact between the blades 52 and the conductors of the wires. Referring also to FIG. 8, a special tool 90 can be provided for simultaneously pushing multiple ones of the blades 52 into the corresponding wires. The tool 90 can be configured to push down on any number of the upper contact portions 56. Preferably, the tool 90 is configured to push down on the upper portions 56 of all of the contacts 18. The tool 90 is sized such that individual tines 92 can be inserted into the upper grooves 32 and contact the upper portions 56 of the arms 50. The tool 90 can be configured differently than as shown, e.g., as a ratcheting-pliers type tool.

At stage 78, the assembled combination of the contacts 18 and the contact casing 14 is inserted, as indicated by arrow 82 in FIG. 2, into the receptacle 22 of the housing 12. The contact casing 14 can be sized to provide a ramp/detent friction fit within the receptacle 22 by press fitting into the housing 12 to inhibit removal of the casing 14 from the housing 12. Alternatively, other techniques for helping to retain the casing 14 within the housing 12 maybe used, e.g., using tabs and slots on the housing 12 and the casing 14.

In use, with the connector 10 assembled as described above, the female connector 10 can receive a male connector for telecommunications. A male connector can be inserted into the receptacle 26 of the housing 12 such that contact of the male connector can touch and make electrical contact with the contact 18 of the connector 10. Thus, telecommunications can be enabled with electrical signals being communicated across the contacts 18 to and from the male connector.

Figure 10:
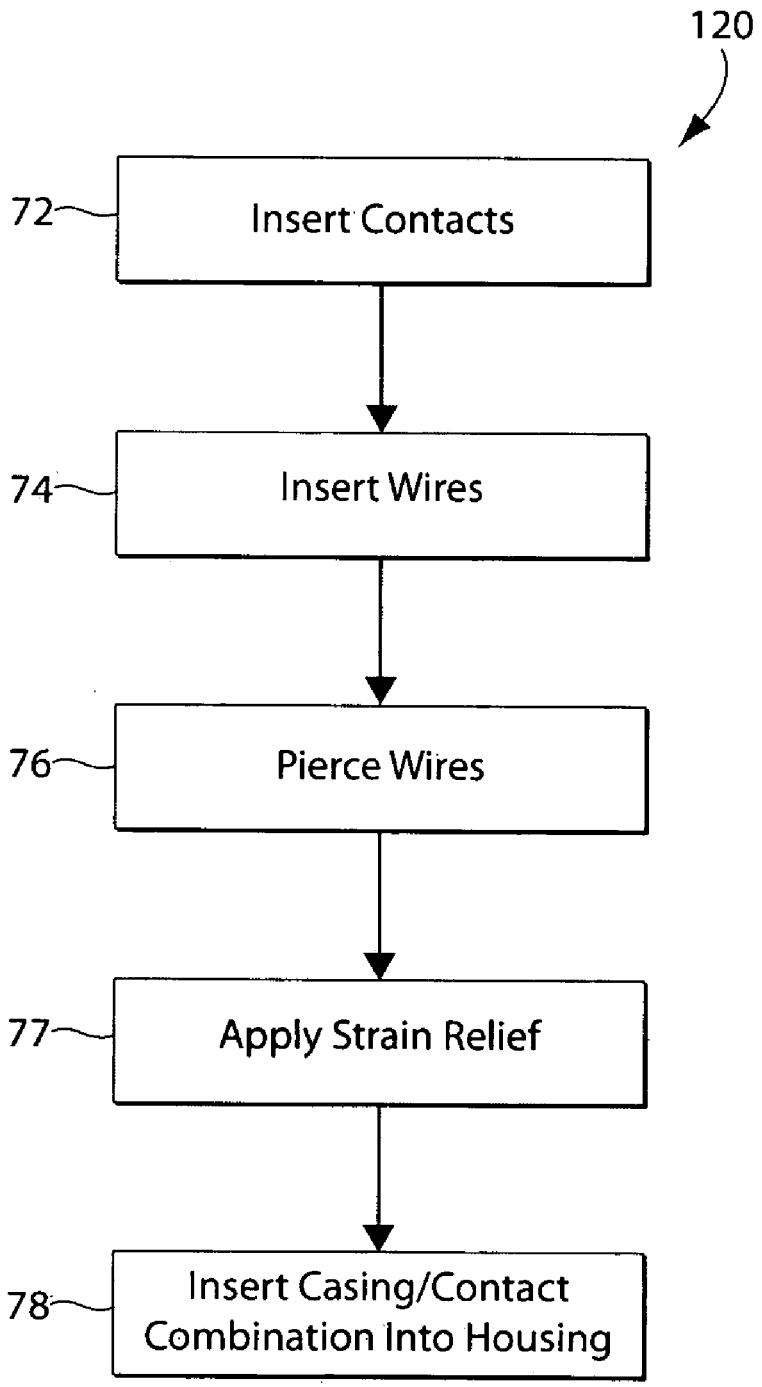
FIG. 10 is a block flow diagram of a process of assembling the connector shown in FIG. 9.

Other embodiments are within the scope and spirit of the invention. For example, used. The contact casing 114 includes a tab 115 that extends downwards to the interior of the casing 114. The tab 115 is wide enough and extends deep enough into the interior of the casing 114 to pinch a wire bundle outer sheathing/jacket 137 that incorporates the wires for making contact with electrical contacts of the connector 110. The tab 115 is configured to be biased against the-cable outer sheathing 137 compressing the cable 137 in place within the casing 114, thus relieving strain on individual wires in the cable 137 and connected to the contact of the connector 110. Referring also to FIG. 10, a process 120 for assembling the connector 110 includes the stages shown. The process 120 is similar to the process 70 shown in FIG. 7 and described above, but the stage 120 includes a stage 77 for applying strain relief. At stage 77, the tab 115 is pushed inward to crimp the cable 137 to inhibit the cable 137 from being pulled from the casing 114, providing strain relief. Strain relief may be provided in conjunction with stage 74 where the wires are inserted into the casing 114, with the tab already being disposed to clamp onto the cable 137 and automatically providing strain relief when the cable 137 is inserted into the casing 114.

Figure 11:
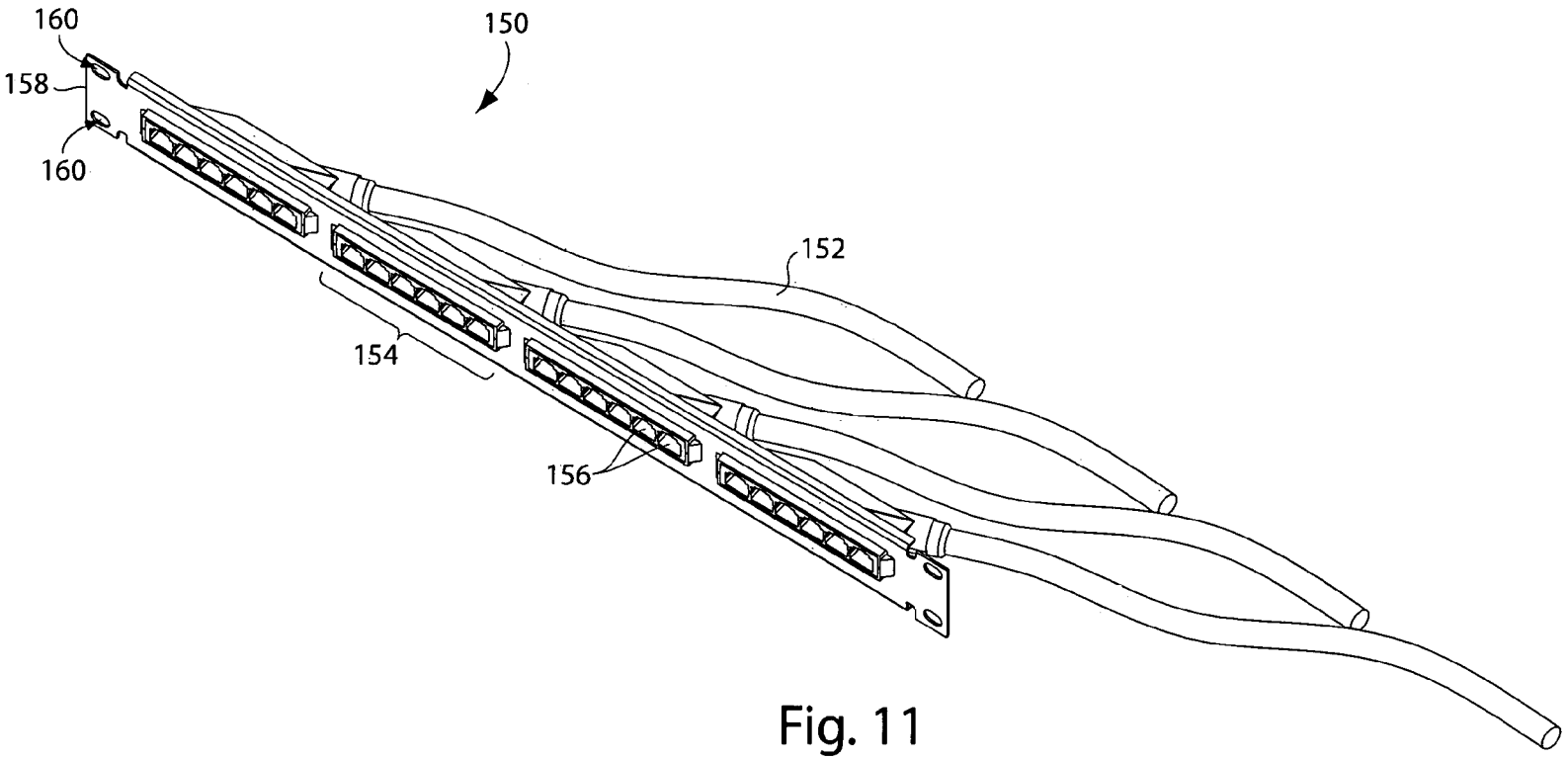
FIG. 11 is a perspective view of a portion of a multi-user telecommunication outlet assembly system.

Referring to FIG. 11, a MUTOA system 150 includes cables 152, multiple sets 154 of connectors 156, and a faceplate 158. Each cable 152 includes 24 pairs of wires for connection to a corresponding one of the sets 154 of the connectors 156. The connectors 156 may be the connectors 10 or the connectors 110, or another embodiment of the connectors according to the invention. Each set 154 includes six of the connectors 156 disposed adjacent to each other, such that each connector 156 is coupled to eight wires from the cable 152. The faceplate 158 provides mounting holes 160, with a matching set of mounting holes on the end of the faceplate 152 that is not shown. The faceplate is approximately 19" long and is configured to be mounted in a standard IT rack for containing IT equipment. The faceplate as shown is a 1U panel is approximately 19" long and is configured to be mounted in a standard IT rack for containing IT equipment. The faceplate provides 4 openings for holding 4 corresponding sets 154 of the connectors 156 providing a 24-port panel. Thus, although only two cables 152 are shown, the system 150 preferably includes 4 cables 152, with 4 corresponding sets 154 of the connectors 156. The faceplate provides approximately 113 mm×19 mm openings for accepting 1×6 MUTOA heads corresponding the sets 154 of the connectors 156, with the associated cable having approximately a 12.7 mm diameter. 'Y' cables incorporating two sets of connector heads in a 2×6 configuration having openings of approximately 113 mm×38 mm may also be used.

Still further embodiments are within the scope and spirit of the invention.

What is claimed is:

1. A telecommunications connector system for connecting to a mating telecommunications jack, the connector system comprising:

a housing that is configured to provide a contact chamber;

a carrier configured to receive a plurality of insulated conductive lines; and a plurality of electrically-conductive contacts at least partially disposed in the carrier, each contact including first, second, and third portions, each of the first portions being movably connected to the second portion and configured to move relative to the second portions in response to applied forces and to return to resting positions in response to removal of the applied forces, each of the third portions being movably connected to a corresponding second portion and including a blade configured to pierce an insulator coating of a corresponding insulated conductive line received by the carrier;

wherein the carrier is at least partially disposed inside the housing such that the contacts are at least partially disposed in the contact chamber.

2. The system of claim 1 wherein the carrier provides a plurality of grooves corresponding to the plurality of contacts such that portions of the contacts can be inserted into the grooves, and wherein walls providing the grooves help to retain the contacts within the carrier and help to electrically isolate the contacts from each other.

3. The system of claim 2 wherein at least the third portions of the contacts are disposed in the grooves and wherein heights of the walls of the carrier providing the grooves have at least two different heights, the walls being relatively smaller under the first portions of the contacts and being relatively larger where the third portions of the contacts are disposed in the grooves.

4. The system of claim 3 wherein the grooves under the first portions of the contacts are configured to allow the first portions of the contacts to move in the grooves.

5. The system of claim 2 wherein the carrier provides a plurality of holes for receiving the insulated conductive lines, the holes being aligned with a respective one of the grooves.

6. The system of claim 5 wherein the carrier includes a plurality of barriers each disposed between a respective one of the grooves and a respective one of the holes.

7. The system of claim 6 wherein the third portions of the contacts are configured to be disposed around the barriers and to move relative to the second portions such that the blades will pierce the insulated conductive lines if the lines are disposed in the holes adjacent to the barriers.

8. The system of claim 5 further comprising the insulated conductive lines, wherein the blades are wedged into the conductive lines through insulator casings of the insulated conductive lines and held in place by friction.

9. A telecommunications cable comprising:

a housing providing a contact chamber and a connector receptacle;

a plurality of insulated wires;

an electrically-insulating contact carrier coupled to the housing and disposed at least partially in the housing and including a set of walls that provide a plurality of grooves, the grooves having first regions of a first depth and a second region of a second, deeper, depth, the contact carrier providing a plurality of wire holes, each wire hole aligned with a corresponding one of the grooves, each of the wire holes including a trough portion in which the carrier provides less than a full circumference wall;

a plurality of electrically-conductive contacts, each contact being a monolithic conductor, each contact including a base portion, an upper portion, and a blade portion, the base portion being disposed in a corresponding one of the grooves, the upper portion being disposed at least partially in the contact chamber and being configured and arranged to bend relative to the base portion to bias against and make electrical contact with a mating contact of a mating connector inserted into the connector receptacle, at least a portion of the blade portion being disposed in the second region of the corresponding groove, the blade portion including a blade disposed through a portion of an insulating shell of a corresponding one of the insulated wires and making electrical contact with the wire.

10. The system of claim 9 wherein each blade of the plurality of contacts biases the corresponding one of the insulated wires against a wall of the carrier providing the trough portion of the corresponding wire hole such that the blade is inhibited, by friction between the blade and the insulated wire, from being removed from insulated wire.

11. The system of claim 9 wherein the system consists essentially of the housing, the wires, the carrier, and the contacts.

12. The system of claim 9 wherein each of the blades includes a plurality of cutting points disposed along a length of the corresponding contact.

13. The system of claim 9 wherein the carrier includes a plurality of barriers separating the first portions of the grooves from the trough portions of the wire holes.

14. The system of claim 13 wherein the contacts are disposed about the barriers, with the blades on first sides of the barriers and the base portions on second, opposite sides of the barriers.

15. A telecommunications connector system for connecting to a mating telecommunications jack, the connector system comprising:

a housing that is configured to provide a contact chamber;

a carrier configured to receive a plurality of insulated conductive lines; and a plurality of electrically-conductive contacts at least partially disposed in the carrier, each contact including a first portion configured to make electrical contact with a corresponding one of the conductive lines, a second portion connected to the first portion by a first bend in the contact, and a third portion connected to the second portion by a second bend in the contact, the third portion being configured and arranged to make electrical contact with mating contacts of a mating connector received by the telecommunications connector system;

wherein the plurality of contacts are each configured to flex at the first bend, such that forces are developed in the first bend, in response to the third portion being pressed upon by one of the mating contacts.

16. The system of claim 15 wherein the carrier is configured to provide room below each of the second portions of the plurality of contacts with the first bends in unflexed states such that the second portions of the plurality of contacts can move into the room as the contacts flex at the first bends.

17. The system of claim 15 wherein the first bend is configured such that the forces developed in the first bend cause reduced amounts of force to be developed in the first portion and the second bend than if the first portion was connected to the second portion without the first bend.

* * * * *